United States Patent [19]

Valenti

[11] Patent Number: 4,497,661

[45] Date of Patent: Feb. 5, 1985

[54] FORMED BRIQUETTES, PROCESS FOR FORMING THE SAME AND PROCESS FOR UTILIZING THE SAME IN THE MANUFACTURE OF METALS

[75] Inventor: Nicholas Valenti, Mayfield Heights, Ohio

[73] Assignee: Ohio & Pennsylvania Fuels Co, Ltd., Mayfield Heights, Ohio

[21] Appl. No.: 557,989

[22] Filed: Dec. 5, 1983

Related U.S. Application Data

[63] Continuation of Ser. No. 291,151, Aug. 11, 1981, abandoned, which is a continuation-in-part of Ser. No. 235,402, Feb. 18, 1981, abandoned, and Ser. No. 129,946, Mar. 13, 1980, abandoned, which is a continuation-in-part of Ser. No. 067,847, Aug. 20, 1979, abandoned.

[51] Int. Cl.[3] ..... C22B 9/10; C21C 7/02

[52] U.S. Cl. ..... 75/256; 75/3; 75/53; 75/58; 75/257

[58] Field of Search ..... 75/256, 257, 3–5, 75/53, 58

[56] References Cited

U.S. PATENT DOCUMENTS

| | | | |
|---|---|---|---|
| 3,340,024 | 9/1967 | Mahar | 75/256 |
| 4,078,915 | 3/1978 | Meichsner | 75/53 |
| 4,362,559 | 12/1982 | Perez | 75/53 |

*Primary Examiner*—Peter D. Rosenberg

[57] ABSTRACT

Formed briquettes of high green strength, high shatter and good compressive strength in the cured state from a composition comprising a metal- and/or carbon-containing waste, one or more reactible isocyanate group containing materials and one or more hydroxyl group containing materials and magnesia. The product can be easily formed by mixing all components at room temperature, introducing the same into a mold, applying pressure and thereafter permitting the same to set. Setting is rapid, and the product can be handled within minutes after molding. The product finds particular use as a replacement in whole or in part for metal and/or carbon sources in steel-making; it has the excellent advantages that the metal and/or carbon content thereof is extremely high and it introduces no harmful impurities into, e.g., steel during steel making.

21 Claims, No Drawings

FORMED BRIQUETTES, PROCESS FOR FORMING THE SAME AND PROCESS FOR UTILIZING THE SAME IN THE MANUFACTURE OF METALS

CROSS REFERENCE TO RELATED APPLICATIONS

This application is a continuation of U.S. Ser. No. 291,151 (now abandoned) filed Aug. 11, 1981, which in turn is a continuation-in-part of U.S. Ser. No. 235,402 (now abandoned) filed Feb. 18, 1981 and U.S. Ser. No. 129,946 (now abandoned) filed Mar. 13, 1980, this latter application in turn being a continuation-in-part of U.S. Ser. No. 67,847 (now abandoned) filed Aug. 20, 1979.

BACKGROUND OF THE INVENTION

1. Field Of The Invention

The present invention relates to formed briquettes, processes for forming the same and processes for utilizing the same in steel making.

2. Description Of The Prior Art

Perhaps the most common method of melting iron is through the use of a cupola wherein coke, a fluxing material such as limestone, and a metallic material are charged. The coke is ignited and air is blasted into the bottom of the cupola to generate intense heat, melting the metallic material which then trickles down through the fluxing material and the coke to the bottom of the cupola. A molten slag is formed on the top of the charge and typically comprises coke ash and similar materials.

While the metallic material is typically iron, it would be a great advantage to the industry if metal-containing waste materials as are typically generated in various manufacturing processes could be utilized as a source of metal in such processes. However, to date, the prior art has not provided any means of simply and economically converting metal-containing waste materials into a form which can be used in a process as above described without the use of harmful binders, without relatively low metal proportions which render the same uneconomical or without the generation of fine particles of metal and like materials which are undesirable.

Further, the coke used in most steel-making processes today is high-quality metallurgical grade coke (preferably low sulphur) which is produced by the distillation (in the absence of oxygen) of coal.

After distillation, handling methods in common use break up relatively brittle chunks of coke into a very fine particulate form of coke called "coke breeze." In general, all coke particles that pass through a one-inch mesh size are too fine for use in blast furnace or a cupola melting process.

The reason that coke breeze cannot be used in the steel making industry is that the air blast and intense heat either immediately consume the coke breeze or blow it out of the cupola, with the coke breeze contributing little or nothing to yield heat and potentially creating the danger of explosion. Coke breeze also tends to reduce the necessary freedom of air flow through the melt because it clogs small passageways between chunks of coke.

Attempts have been made in the prior art to form coke breeze into briquettes. However, prior art briquettes have been subject to a number of problems. The most common problem of prior art coke briquettes is that the briquettes have been too brittle to withstand bulk handling and crumble or break into coke breeze.

Attempts have been made to use high proportions of binder to overcome this problem, but when the amount of binder has been increased to an extent that the briquettes are no longer brittle, the amount of binder is so high that it leads to an undesirable amount of slag in the steel-making or iron melting processes and actually can introduce undesirable impurities into the steel, reducing product value.

A further problem of many prior art processes is that high heating conditions are required to form the charge to be briquetted, or high temperature or extended curing times are necessary to form the briquette.

U.S. Pat. No. 4,179,283 Rehder discloses metal oxide-carbon compacts for reduction and combustion in various types of furnaces. Rehder contemplates the mandatory use of two specific types of carbon and does not contemplate the use of metals as is the case per the present invention. Further, the binder systems disclosed in Rehder are totally dissimilar from those of the present invention.

U.S. Pat. No. 3,832,158 Obenchain discloses a process for producing metal from metal oxide pellets in a cupola-type vessel. In a manner similar to Rehder, Obenchain admixes a metal oxide and a carbonaceous material. The only binders disclosed are cementitious materials, which binders are dissimilar from those of the present invention.

U.S. Pat. No. 3,156,557 Dahl et al discloses aggregates of ore, a carbonaceous reducing agent, a flux and a cementitious binder. Dahl et al is cumulative to Rehder and Obenchain and subject to the defects thereof.

Many other processes are also known wherein metal or metal oxides in crude form are processed to final product form, for example, the reduction of chrome concentrates, oxides or ores to ferro-chrome, the reduction of manganese ores to ferro-manganese and the like, and it would be a substantial benefit in such processes if chrome or manganese-containing waste materials could be processed therein.

U.S. Pat. No. 755,278 Kruikshank teaches the manufacture of artificial fuel blocks from anthracite culm, resin dust, asphalt and benzin.

U.S. Pat. No. 756,124 Lieb teaches producing fuel briquettes from a combination of fine coal and resin.

U.S. Pat. No. 1,443,618 Davies discloses a process of making coke which comprises adding substantial proportions of resinous binder to a suitable coal, and then carbonizing the system. A carbonization is required to form the product and very high proportions of binder are present in the finished briquette. The Davies product is also highly perforated to increase the escape of volatile products during carbonization, a procedure not contemplated in the present invention.

U.S. Pat. No. 2,567,136 Vloeberghs discloses fuel agglomerates and a process for manufacturing the same which comprise finely divided anthracite, not less than 6% waste sulfite liquor from the manufacture of cellulose and less than 3% of a synthetic resin such as a phenol-formaldehyde resin. Vloeberghs does not disclose the binder system of the present invention and, due to the presence of the waste sulfite liquor in Vloeberghs, no doubt high amounts of sulfur would be introduced into steel if one contemplated using the Vloebergh agglomerate in a steel-making process.

U.S. Pat. No. 3,402,031 Schick et al discloses an artificial carbonaceous fuel composition particularly adapted for orchard heating. The briquettes comprise a mixture of petroleum coke, wood sawdust, charcoal, an oxidizing agent capable of supporting combustion and a heat-sensitive binder. Useful binders include sugar, molasses, phenolic resins such as phenol-formaldehyde, etc. Other than the use of a resin, which is not the same as that of the present invention, Schick et al differ on almost all points from the present invention.

U.S. Pat. No. 3,836,343 Romey et al discloses carbon-containing briquettes wherein particulate carbonaceous material is mixed with an aqueous suspension of copolymers of butadiene-acrylonitrile.

U.S. Pat. No. 3,843,336 Messman discloses an artificial fireplace log comprising a particulate woody material in combination with a thermoset resin which provides a polymerized casing for the fireplace log. Useful resins include those condensable in thermosetting fashion such as phenol-formaldehyde, resorcinol-formaldehyde or epoxy resins.

None of the references discussed above suggest a briquette exhibiting the unique characteristics of the briquette of the present invention, utilize the binder system of the present invention or suggest utility of the coke-based fuel briquette in steel and/or iron manufacture.

U.S. Pat. Nos. 2,665,977, Engelhart, 4,063,944, Behring, 4,078,902, Olson, and 3,762,886, Triska, disclose fuel briquettes using cement as a binder, certain of these patents disclosing coke breeze being bound by the cement.

Fuel briquettes formed in accordance with this type of prior art is subject to the fault that they exhibit a high ash content and cement is alien to steel-making processes.

U.S. Pat. Nos. 2,508,878, Yates et al., and 2,979,388, Brown et al., disclose the use of organic materials such as asphalt, pitches, thermal tars, and the like, as a binder for a carbonaceous material. The products of these two patents differ substantially from those of the present invention and are subject to the fault that binder materials as are utilized are essentially viscous materials, and they break down during the steel-making or cupola melting process at too early a stage to effectively function in a manner similar to coke.

U.S. Pat. No. 3,676,162, Mehler et al., discloses a basic refractory material for lining steel converters which comprises sintered magnesia bonded with sodium polyphosphate or magnesium sulphate and impregnated with liquid tar. Such a product has a utility opposed to that of the product of the present invention.

U.S. Pat. Nos. 3,879,209 and 4,059,455, both of Limes et al., and 3,960,580, Stierli et al., disclose fastsetting concrete compositions which include magnesia and ammonium polyphosphate.

The following patents generally deal with briquetting finely divided materials: U.S. Pat. Nos. 1,507,674, Nagel, 1,661,636, Simpson, 2,029,309, Curtis et al., 2,711,951, West et al., 3,617,254, Emperato, Jr., 3,674,449, Schmalfeld et al., 3,730,692, Halowaty et al., 3,838,988, Sanada et al., 3,841,849, Beckmann, and 4,015,977, Crawford.

In all of these patents, there is no disclosure of the unique briquette of the present invention nor the properties thereof.

U.S. Pat. Nos. 3,285,758, Limes et al., and 3,413,385, Komac et al., deal with basic refractory compositions and processes for repairing, refractory walls, respectively, wherein a magnesia/ammonium phosphate binder is used.

U.S. Pat. No. 3,708,317, Owen, discloses a metallurgical furnace lining and U.S. Pat. No. 3,826,662, Paolini, discloses a trowelable patching mix for refractory linings containing coke breeze, fire clay and pitch.

U.S. Pat. No. 33,020 Quann discloses a process for reducing iron ore using a solution which includes pulverized charcoa, ammonium carbonate, etc.

U.S. Pat. No. 1,562,564, Kattner discloses briquetting fuels with magnesia cement.

U.S. Pat. No. 2,582,386 Komarck et al discloses a fuel briquette comprising flue dust, clay and an inorganic ammonium compound.

U.S. Pat. No. 4,165,221 Valenti discloses carbon-containing briquettes which are formed from a composition comprising carbon, magnesia and an aqueous ammonium polyphosphate solution. Such introduce harmful phosphorous during steal making.

SUMMARY OF THE INVENTION

The present invention relates to a metal- and/or carbon-containing briquette possessing unique characteristics for supplementing, in part, the metal-containing charge and/or carbon charge to various processes such as in a foundry, in a blast furnace, in other steel-making applications and in the production of various other types of metals, which metal-containing briquette is formed by a simple process.

One object of the present invention is to provide a metal- and/or carbon-containing briquette which permits waste materials generated during various manufacturing processes to be efficiently and economically utilized, which waste materials currently have no substantial use.

A second object of the present invention is to provide a metal- and/or carbon-containing briquette which has excellent green strength and can be handled safely with minimal breakage within minutes after molding the same.

A third object of the present invention is to provide metal- and/or carbon-containing briquettes which possess excellent shatter and compressive strength.

Yet another object of the present invention is to provide metal- and/or carbon-containing briquettes which can be used as part of a cupola charge and which have the characteristics which render them compatible with the charge to the cupola.

Yet a further object of the present invention is to provide a metal- and/or carbon-containing briquette for use in a steel-making process such as a foundry, blast furnace and/or other steel-making process, which contains high proportions of metal and or carbon and low proportions of binder.

Yet another object of this invention is to provide a metal- and or carbon-containing briquette for use in a steel-making process which introduces substantially impurities such as phosphorous into the resultant steel, which can be harmful in certain cases, and which yields lessened amounts of slag contributing products.

A further object of the present invention is to provide a simple process for forming such metal- and or carbon-containing briquettes, which process can be practiced at ambient temperature without the need for high-temperature curing and with simplified apparatus.

Another object of the present invention is to provide metal-containing briquettes as above described which can be utilized in the reduction of chrome concentrates and other chromium sources such as chrome oxide or chrome ore to ferro-chrome, for reducing manganese ores to ferro-maganese, and in like processes where the metal therein can be used as part of the feed to the process.

A further object of the present invention is to provide a briquette possessing unique characteristics which enables it to replace, in whole or in part, coke, including, but not limited to, high-grade metallurgical coke, in a foundry cupola, blast furnace and/or other steel-making applications.

Yet another object is to provide a briquette which can replace coal, be it anthracitic or bituminous, as a combustion fuel.

An additional object of the present invention is to provide a briquette which permits low grade coal or coke to be upgraded in quality, e.g., which can use a waste material generated during the handling of metallurgical coke to be efficiently and economically utilized, viz, coke breeze, or which permits coal dust to be similarly upgraded into a useful coal product.

Yet another object of the present invention is to provide fuel briquettes which can be used as part of a cupola charge, which burn evenly and smoothly throughout the iron melting process, and which have characteristics substantially identical to cupola coke until completely consumed within the cupola.

Yet a further object of the present invention is to provide fuel briquettes for use in the cupola melting process which have a carbon content approximating that of coke currently used in foundry, blast furnace and/or steel-making processes, including, but not limited to, high-grade metallurgical coke, i.e., which contain high proportions of coal and/or coke and low proportions of binder, and which are useful as a partial or complete replacement for coke in such processes.

A further object of the present invention is to provide a steel-making or gray iron making process using metal- and/or carbon-containing briquettes as above described.

Another object of the present invention is to provide briquettes which comprise various desired additives as later exemplified, e.g., kisch, silicon carbide, etc.

The metal- and/or carbon-containing briquettes of the present invention are formed from a mixture comprising one or more metal-containing materials and one or more carbonaceous materials, typically one or more metal-containing waste materials and/or coke breeze or coal fines, magnesia and one or more reactible isocyanate group containing materials and one or more hydroxyl group containing materials.

The process of the present invention simply comprises mixing the components identified, substantially immediately pouring the resulting mixture into a mold, applying a compressive force thereto and permitting the same to sit for a few minutes at ambient temperature or at an elevated temperature while the system sets, and thereafter removing the same from the mold.

The steel-making or gray iron making process of the present invention is substantially equivalent to conventional steel-making processes, except that the charge thereto can be supplemented by the briquette of the present invention.

DESCRIPTION OF THE PREFERRED EMBODIMENT

Hereafter, all percentages, parts and like figures are by weight, unless otherwise indicated.

Product Aspects

As indicated, the metal- and/or carbon-containing briquettes of the present invention are formed from a composition which includes the following essential components: a metal-containing material and/or a carbonaceous material, magnesia and one or more reactible isocyanate group containing materials and one or more hydroxyl group containing materials. In a most preferred, and highly economic embodiment of the present invention, the metal-containing material is a waste material and the carbonaceous material is coke breeze or coal fines, hereafter referred to as coke and coal for brevity. Other different embodiments are later set forth.

The Metal-Containing Material

As one skilled in the art will appreciate, the metal-containing material utilized in forming the briquette of the present invention can come from various sources. However, for practical purposes, the present invention finds most substantial application in the use of metal-containing waste materials which do not have substantial use. Thus, the present invention not only provides a valuable supplement to various steel-making and similar processes, but it permits a heretofore useless material to be economically utilized. Accordingly, hereafter, the metal-containing material utilized to form the briquettes of the present invention will be discussed in the context of a metal-containing waste material, though the present invention is not per se limited to such.

Essentially any metals used in steel-making and like processes can be utilized to form the briquette of the present invention. For example, waste cast iron, waste steel including stainless steel and related materials can be used to form the briquette of the present invention which can then be used in a cupola, blast furnace or in an electric melt furnace.

Specifically, the metal-containing waste material used to form the briquette of the present invention includes mill scale, filter cake, blast furnace dust, pellet fines, taconite fines, taconite per se, open hearth dust, powdered iron ore, electric furnace dust, metal filings in any form, metal turnings and metal borings in any form, chrome oxide, chrome ores, manganese ores, etc. Thus, the present invention relates to the use of metals and/or metal oxides in any form that can be briquetted and will find use in steel-making and similar processes. As will be appreciated by one skilled in the art, the term "metal-containing material" as used herein includes, metal-containing, metal oxide-containing and metal- and metal-oxide containing materials.

I have found in a preferred embodiment that metal filings as are produced as a waste product in the machining of cast iron, e.g., in the milling of cast iron engine blocks, are useful in the present invention. Such filings often will have a wide size range including relatively large metal filings down to very fine almost hair-like filings, and such can be used herein. Such filings are especially a problem with modern engine milling techniques where the waste is of a finer and finer size which cannot be hydraulically compacted and cannot be used in any practical fashion without a binder.

While not limitative as a critical parameter, typically, the metal-containing materials used herein will comprise particles or filings having a size of about 2 inches or less. Larger particles, of course, could be used herein, but generally such are useful per se as a steel-making charge and are not economical in the present invention. The minimum size of the metal-containing waste is not important since the present invention can be practiced even with dust-like materials. Commonly, the metal-containing waste will comprise a mixture of particles having a size of from 2 inches minus or smaller with 1 inch minus or smaller metal-containing materials being more commonly available.

It is not necessary that the metal-containing waste used in the present invention be treated in any special fashion prior to forming the metal-containing briquettes of the present invention, i.e., it can be used directly as a waste material from various machining procedures. I have found, however, that materials which are heavily coated with oil are not amenable to processing per the present invention, and if such are to be utilized the oil should be substantially removed prior to formation into a briquette per the present invention. In a similar fashion, hot metal filings are not preferred for use since they potentially could cause the binder system to set up on the surface thereof before adequate mixing.

While all of the above materials are useful metal-containing materials per the present invention, I wish to maintain a line of distinction between materials such as taconite and mill scale and materials such as metal borings and the like, i.e., a line of distinction between oxide materials and metal materials. In the situation where a metal oxide-containing material is used as the waste material to form the briquette of the present invention the reaction in steel-making and like processes utilized is a chemical reaction. In distinction, when a metal material such as a filiing, boring or the like is utilized there is no chemical reaction, rather, the metal, typically iron in the metal-containing waste material, merely remelts. In the former situation, carbon is mandatory whereas in the latter situation carbon is optional.

Of course the term "metal" as used herein also includes alloys and mixtures of metals, alloys, oxides, etc.

The briquettes of the present invention which comprise a cross-linked reaction product and a source of magnesia can also be used to introduce various other materials into steel-making and related processes as later described, e.g., bronze, copper, brass, aluminum, kisch, ferrisilicon, silicon carbide, foundry sand, carborundum, mixtures thereof, etc., and such materials can be present alone as an essential additive or in combination with, e.g., metal-containing material(s) as earlier exemplified and/or carbonaceous material(s) as later exemplified, etc.

For instance, the main component(s) of a briquette per the present invention other than cross-linked reaction product and source of magnesia might be cast iron filings and or coke breeze; nonetheless for a particular process, e.g., kisch and/or SiC might be desired. In such case, the desired proportion(s) of kisch and/or SiC would be added to the cast iron filings and/or coke breeze composition used to form the briquette in proportions as desired.

As another example, one might wish to form a briquette to introduce, e.g., essentially only aluminum. In such case the briquette would comprise cross-linked reaction product, source of magnesia and aluminum without other metals and/or coke.

Proportions of the active ingredient, e.g., kisch, SiC, etc., will generally be along the lines of those later disclosed for the metal-containing material and/or coke/coal, though where, e.g., low amounts are ancillary to primary amounts of e.g., coke and/or coal, the proportion will be low, and processing conditions to form the briquette are as later exemplified. Size is not overly important and will typically be along the lines discussed above for the metal-containing material.

Use will typically be in steel making and related processes, though such is not limitative.

The Carbonaceous Material

Per the present invention the carbonaceous material is typically fine coke and/or coal. The exact nature of the coke or coal used in the present invention is not overly important and large and/or small particles of coke or coal can be used.

Although size is not overly important, since one particular and preferred object of the present invention is to upgrade coke or coal of limited utility and value, i.e., coke or coal having a small particle size, it is often preferred in accordance with the present invention to use coke or coal having a particle size of $\frac{3}{4}''$ mesh pass or smaller. The minimum particle size is not important, and I have found that I can successfully process coke or coal as is commonly available as a waste or breakage product from handling coke or coal.

One particularly, and highly preferred, material used in the present invention is coke breeze. Since this is a highly preferred material, hereafter the present application will often be discussed in terms of this most preferred embodiment. It shall be understood, however, that the present invention is not limited to the use of coke breeze. Unless otherwise indicated, any discussion regarding coke breeze applies in general to other types of carbonaceous materials such as coke or coal, be the coal anthracitic, bituminous, etc.

The coke breeze as used in the present invention is conventional, i.e., it is a waste product from the bulk handling of high-grade metallurgical coke.

Coke breeze as is generally available as a waste product is useful in the present invention. Coke breeze often will have a particle size range including relatively large particles down to very fine dust-like particles, and such can be used herein. Alternatively, if the coke breeze has been sized to a fairly uniform diameter, such can also be used in the present invention.

While not limitative as a critical parameter, typically, coke breeze will comprise particles having a size of about 2 inches or less. Larger particles, of course, could be used herein, but generally such are useful per se as coke and are not economical in the present invention. The minimum size of coke breeze is not important since the present invention can be practiced even with dust-like breeze. Commonly, the coke breeze will comprise a mixture of particles having a size of from 2 inches minus or smaller with 1 inch minus or smaller coke breeze being more commonly available. Usually the coke breeze will have an average size on the order of $\frac{1}{8}''$ or less.

It is not necessary that the coke breeze used in the present invention be treated in any special fashion prior to forming the briquettes of the present invention, i.e., it can be used directly in its form as a waste material from the bulk handling of high-grade metallurgical coke. Generally, however, I most prefer that the coke breeze have a moisture content of about 6% or lower, by weight. Too high a moisture content will tend to somewhat reduce the strength of the final briquette, and such is undesirable. In those instances where the coke breeze has an excessively high moisture content, it is preferred that the coke breeze either be dried or mixed with coke breeze which is drier to provide a final moisture content of, e.g., about 3 to about 6%, by weight, or lower. As I later discuss, it may also be possible that high amounts of moisture will "poison" metal ion catalysts as sometimes used in the present invention, though I have not encountered this problem based upon my experience, and thus at present I believe that very high amounts of moisture should be avoided in the coke or coal processed in accordance with the present invention.

The Magnesia

The magnesia used in the present invention serves as a source of magnesium oxide. It does not enter into the steel-making process but assists in "expanding" the binder system of the present invention. Thus, there is no particular limitation on the particle size of the magnesia so long as it presents sufficient surface area, either by being of a relatively fine size and/or through adequate mixing, to "expand" the binder system. The magnesia can, if desired, be of a substantially uniform size or have a particle size range down to dust-like powder. I have found that magnesia of ⅜ inch minus functions well in the present invention, and, hence, such is preferred, but this is not limitative as the magnesia particle size is selected to provide desired density and other properties in the briquette.

The magnesia used in the present invention can be pure MgO, but this is not preferred or necessary. More typically and preferably, it is in the form of highly calcined or dead-burned magnesite of a fine particle size, or may be calcined dolomite having a substantial magnesia content or may be present in line, e.g., 40% MgO/60% CaO. What is important at this point of the invention is that any such particulate magnesium oxide source be capable of interacting with the binder system to expand the same. Impurities, i.e., non-MgO materials, as are commonly found in the above-identified commercially available industrial materials have not to date been found to be harmful (typical impurities are CaO, $SiO_2$, $Al_2O_3$, $Fe_2O_3$—this latter material is, of course per se useful in steel-making and related processes but typically is present only in very minor proportions as a trace or like amount impurity). I prefer, however, that any calcined or dead-burned magnesite or calcined dolomite have an MgO content of at least about 80%, more preferably about 87% or greater, though this is not mandatory. While the above magnesia materials can be used alone or as mixtures thereof, I most prefer to use dead-burned magnesite as the magnesium oxide source. The magnesia also appears to exert a "flame retardant" effect to prolong briquette life.

Hereafter, for brevity, I will merely use the term "magnesia" to generically refer to all of the above materials which serve as a source of MgO.

The magnesia should comprise at least about 1%, by weight, of the briquette, and to avoid the need for excessive mixing prior to setting, I prefer to insure that the magnesia comprises no more than about 5% to about 6% by weight of the final briquette. While such high proportions of magnesia are not theoretically required, they may permit mixing to be conducted without having to pay critical control to either mixing intensity or time or magnesia particle size and still obtain a useful product. I believe that if I used finely divided magnesia and/or intense expensive or long-term mixing, I could achieve the same results with low magnesia percentages as with higher since I would have good contact between the magnesia and other components.

Higher proportions of magnesia can be used, of course. For example, it does not seem that high magnesia proportions have any harmful effect on the briquette, but since magnesia has a cost much higher than the waste materials used, the use of higher amounts thereof tends to defeat one important object of a preferred embodiment of the invention, i.e., to enable large amounts of current waste material(s) to be used in steel-making processes.

Simply stated, the minimum proportion of magnesia is important to insure good, easy bonding with the resin binder system, but the maximum amount thereof seems to be more economically oriented, i.e., after an amount sufficient for bonding is present, the excess does not assist bonding, remains inert at use and, very importantly, displaces waste material(s), which is not only desired in the briquette but is of very low cost. For example, amounts of magnesia up to, e.g., 20%, by weight, or higher, might provide bonding but undesirably lower the waste material(s) content and increase cost unnecessarily.

The Binder System

The binder system of the present invention comprises, as mandatory components, one or more reactible isocyanate group containing materials, and one or more reactible hydroxyl group containing materials. Unless otherwise indicated, the term "binder system" hereinafter refers to these mandatory components.

The binder system of the present invention is predicated upon the reaction of the reactible isocyanate group containing materials (technically, the NCO groups thereof) and the reactible hydroxyl group containing materials (technically, the hydroxyl groups thereof) to form a cross-linked (cured) product. While curing can be at extended times or at elevated temperature by heating, e.g., as described in U.S. Pat. No. 3,432,457 Robbins, I often prefer to use a catalyst which permits a cured reaction product as above described to be quickly obtained at room temperature.

The reactible isocyanate group containing materials used in the present invention include as preferred materials the polyisocyanates, i.e., compounds containing at least two isocyanate groups. The exact polyisocyanate is not especially limited and includes polyisocyanates per se, isocyanate prepolymers and modified polyisocyanates.

The polyisocyanate is employed in sufficient concentrations to cause the curing of the phenolic resin and other active hydrogen containing materials when present. This refers to materials with hydrogen atoms which display activity according to the well-known Zerewitinoff method as described by Kohlen in JACS, 49, 3181 (1927).

Useful polyisocyanates are disclosed in each of the patents in the following section dealing with the reactible hydroxyl group containing materials.

The reactible hydroxyl group containing materials include, for example, polyhydric alcohols, copolymers containing reactive hydroxyl groups and alkyd resins (preferably oil-modified) as disclosed in U.S. Pat. No. 3,385,345 Miraldi, hereby incorporated by reference; polyethers, polyesters or polyetherpolyols as disclosed in U.S. Pat. No. 3,687,297, Kuhn et al., hereby incorporated by reference; drying oils as described in U.S. Pat. No. 3,255,500 Engel et al., hereby incorporated by reference; aliphatic or aromatic ethers as disclosed in U.S. Pat. No. 3,933,727 Schmid, hereby incorporated by reference; furan or furan alcohol modified aldehydes as disclosed in U.S. Pat. No. 3,925,296 Stone, hereby incorporated by reference; hydroxyl group-containing organic binders as described in U.S. Pat. No. 3,428,110 Waler et al. at Col. 2, lines 28–49 and Col. 3, lines 8–18, hereby incorporated by reference; oil modified alkyd resins as described in U.S. Pat. No. 3,403,721 Robbins and U.S. Pat. No. 3,426,831 Robbins, both hereby incorporated by reference.

While I have not worked extensively with all of the above binder systems, they appear operable in the present invention but are each subject to one or more faults. Thus, I prefer to use binder systems as disclosed in U.S. Pat. Nos. 3,726,867; 3,702,316; 3,409,579; 3,429,848; and 3,432,457; all to Robbins and all hereby incorporated by reference, and for economic reasons most prefer to use a binder system comprising a hydroxyl terminated polyester, a liquid polyisocyanate with 2–5 isocyanate groups and a catalyst, all as described in U.S. Pat. No. 3,385,345 Miraldi, earlier incorporated by reference. Quite often hereafter I refer to the preferred phenolic and hydroxyl-terminated polyesters as merely "hydroxy resins" for brevity.

At present I often use the basic catalysts of U.S. Pat. No. 3,703,816 but it also appears the ionic catalysts or tertiary amine catalysts disclosed in the other Robbins patents are equally as useful as are other catalysts later discussed for phenolic resin systems. The Robbins patents, of course, deal with shaped foundry articles such as foundry aggregates used to form cores for use in making metal castings. To me, it was quite surprising that binder systems as disclosed in Robbins for use in making foundry cores, i.e., molds, could be used to successfully form the briquette of the present invention.

As is well known to those in the foundry aggregate art, aggregates are typically inert materials and foundry cores are not exposed to the temperatures involved in steel and/or iron-making. Further, as is also known, foundry cores are typically used once and it is generally desirable that the foundry cores be easily destroyed. Thus, to me it was quite surprising that the binder systems of the Robbins and Miraldi patents could be used to form a briquette which would withstand the rather rough material handling processes of steel and/or iron-making and yet provide a briquette which would, when coke or coal is used, combust during steel and/or iron-making in a controlled fashion without breaking apart during steel and/or iron-making. The requirements of a briquette of the present invention are, in my opinion, basically opposed to the requirements which one skilled in the art would pose for the formation of a foundry core.

While it is to be understood that the present invention is of wide application with reactible isocyanate group containing materials and reactible hydroxyl group containing materials as above, the following discussion will often be in terms of preferred polyisocyanate compounds/hydroxy resins as disclosed in the above Robbins and Miraldi patents. Unless otherwise indicated, discussion below also applies to non-preferred embodiments with respect to proportions, processing conditions, etc.

Most Preferred Embodiments of the Invention

Although the binder systems of the five Robbins patents and the Miraldi patent above incorporated by reference are in general useful in the present invention, since the briquettes of the present invention differ in substance from the types of products disclosed in these patents, I do have certain preferences from the binder systems of these patents, as discussed below.

The first component of the most preferred binder systems of the present invention is a phenolic resin or a hydroxy-terminated polyester.

If a water-sensitive catalyst is used, the resins should be substantially free of water and are preferably soluble in an organic solvent.

The term phenolic resin as used herein is meant to include any polymeric condensation product obtained by the reaction of a phenol with an aldehyde. The phenol should not be substituted at either the two ortho positions or at one ortho and the para position since these unsubstituted positions are necessary for the polymerization reaction. Other than the above restrictions, one or all of the remaining carbon atoms of the phenol ring can be substituted. Most preferred phenolic resins are described at Col. 2, line 36 to Col. 3 line 57 of U.S. Pat. No. 3,702,316 Robbins (hereafter, unless I otherwise indicate, when I refer to the Robbins patent it refers to this Robbins patent) and in U.S. Pat. No. 3,409,579 Robbins.

The aldehydes reacted with the phenol can include any of the aldehydes heretofore employed in the formation of phenolic resins, though typically formaldehyde is used. I prefer to use the aldehydes described in the Robbins patent at Col. 3, lines 50 to 57.

I can use novolak or resole resins as the phenolic resin component of the binder system of the present invention, though I prefer to use novolak resins.

A further preferred hydroxyl material is a polyester and for pratical purposes, a hydroxyl terminated polyester resin.

Polyester resins are products of the chemical condensation of glycols and unsaturated dibasic acids by esterification. Maleic anhydride is the unsaturated dibasic acid most commonly used. The common glycols are propylene, dipropylene, ethylene, diethylene, and neopentyl—singly or in combination.

Frequently, saturated acids such as phthalic anhydride, isophthalic acid, or adipic acid are used with unsaturated acids to control the degree of unsaturation.

I believe that a strong, three-dimensional polymer is produced when the polyester and isocyanate are chemically bonded together, generally by the addition and activation of a catalyst, such as an organic peroxide.

While I do not have precise molecular weight measuring equipment, I believe that the polyesters I use typically have a molecular weight, based on my reading, of about 1,500 to 5,000, some preferably about 1,500 to 3,500, though I do not view this as limitative.

In general, I prefer to employ resins which have been prepared from the following classes of ingredients:

(a) polyhydric alcohols having at least three hydroxyl groups, e.g. glycerol, pentaerythritol, trimethylol propane and the like. Pentaerythritol is preferred. Mixtures of polyhydric alcohols can be used. While glycols can be used, better results are obtained if such glycols are used in conjunction with the polyhydric alochols (use a mixture of ethylene glycol and pentaerythritol). I most prefer to use a mixture of pentaerythritol and di- and tri-ethylene glycol.

(b) polycarboxylic acids (or their anhydrides) such as $C_6$–$C_9$ unsaturated dibasic acids and, e.g., maleic acid, fumaric acid, phthalic acid, phthalic anhydride, isophthalic acid, chlorendic acid and the like. Mixtures of acids can be used. At present, I do not believe the exact polycarboxylic acid(s) selected is(are) overly important.

When I use the combination of a polyisocyanate with a polyester, I have often found about 60 wt% polyester to about 40 wt% polyisocyanate to give good results, though this is not limitative. As I later discuss, I prefer to use a metallic catalyst with such a system, and, based on manufacturers' information, do not believe it necessary to use more than about 5 wt% catalyst, based on polyester weight. The current system I prefer to use is available from United Erie under the tradename "Deepset" comprising, according to their advice, their CM7 resin (polyisocyanate) and "CATALYST" (actually a hydroxyl terminated polyester and a few percent dibutyl tin dilaurate or stannous octoate).

The second component of the most preferred binder system of the present invention is a polyisocyanate which, for all practical purposes, should be a liquid polyisocyanate or be in solution when used to insure good contact with the metal waste material(s) and/or coke or coal, having at least two isocyanate groups per molecule. The liquid polyisocyanate can be an aliphatic, cycloaliphatic, or aromatic polyisocyanate preferably having from 2 to 5 isocyanate groups. Aromatic polyisocyanates appear to work best. Isocyanate prepolymers can be used, though I believe these are less preferred in the present invention than polyisocyanates. Preferred polyisocyanates include those described in the Robbins patent at Col. 3, line 58 to Col. 4, line 7.

I find it most convenient to use the hydroxy resin component of the binder system of the present invention as a solution in an organic solvent. The amount of solvent used should be sufficient to permit uniform coating of the metal waste material(s) and/or coal or coke of the present invention and substantially uniform reaction of the binder system. The solvent concentration can vary greatly, but it is convenient that the solvent be about 5 to about 80% of the hydroxy resin solution.

A liquid polyisocyanate is not necessarily used in an organic solvent, though typically I prefer to use the polyisocyanate, most preferably a liquid polyisocyanate, in organic solvent solution form. Usually I prefer to use about 50% or less solvent, based on the polyisocyanate solution. While not especially binding, the liquid polyisocyanate is usually used in an amount of about 10 to about 500% of polyisocyanate based upon the weight of the hydroxy resin used.

Several useful solvents are set out in U.S. Pat. No. 3,726,867 at column 7 and in U.S. Pat. No. 3,432,457 at columns 6 and 7.

Generally, I prefer to use the minimum amount of binder system possible in forming the briquette of the present invention. This is for a number of reasons. Firstly, the binder system is the most expensive component of the briquette of the present invention. Thus, lesser proportions of the binder system lower product cost. Secondly, increasing proportions of binder system in the briquette of the present invention reduce the amount of metal waste material(s) and/or fixed carbon of the briquette, which is generally undesirable. Finally, while the binder system of the present invention does not introduce harmful impurities into steel or iron during use, such as phosphorus, by using the lowest possible amount of binder system I minimize the presence of organic components which might be introduced into the steel or iron from the binder system.

The amount of binder system used must, of course, be sufficient to ensure that the metal waste material(s) and/or coke and/or coal is adequately bonded to withstand material handling procedures during steel and/or iron-making, and must be sufficient to ensure that the fuel briquette maintains a coherent shape during steel and/or iron-making.

I currently prefer to use on the order of at least about 5% binder (as solid components) based on total briquette weight. Thus, for a typical system as described in the Example 1, 7 weight % of binder system is used to form a 4 pound fuel briquette in accordance with the present invention. I have found that using as little as about 1% binder system based on total briquette weight, will generally provide a briquette which, upon the application of a sudden striking force, will break. While it is possible that super-efficient mixing of the binder system of the present invention with the metal waste material(s) and/or coke and/or coal might permit as little as 1% to be effective, at present I believe that the cost of the equipment necessary to achieve such super-efficient mixing would not be justified, and thus I use more than about 1% of binder to form a useful product, and believe to be safe one should use at least 3% binder (as solid components) based on total briquette weight.

Greater amounts of binder system can, of course, be used. However, at present there does not appear to be any substantial benefit achieved by using greater amounts of binder system, rather, the amount of metal waste material(s) and/or fixed carbon is reduced and the cost of the product is increased. While fixed carbon levels will vary with various steel and/or iron-makers, based upon my present experience I believe that most steel and/or iron-makers would find a binder proportion of greater than about 15% unacceptable. In fact, I commonly find binder amounts of greater than about 10% (as solids) based on total briquette weight to ooze from the briquette during compression. Based on my present experience, binder in an amount of about 5 to about 10% (as solids) based on total briquette weight appears to provide the best results.

The final preferred component of the binder system of the present invention is a catalyst. I most prefer, at present, to use a base as described in the Robbins Patent, though ionic catalysts as described in U.S. Pat. No. 3,432,457 Robbins and tertiary amines as described in U.S. Pat. No. 3,409,579 Robbins are also useful when using a phenolic resin, and the following discussion deals with phenolic resin system catalysts.

The bases of the Robbins patent have a pKb of about 7 to above 11.

Preferred bases are described in the Robbins Patent at Col. 4, lines 34 to 59. These catalysts permit a certain working (mixing) time without substantial curing and then rapidly set.

Preferred ionic catalysts are metal ions as disclosed in U.S. Pat. No. 3,432,457 Robbins patent at Column 5, lines 31 to 66.

Examples of suitable ionic catalysts are lead neodecanoate, zinc neodecanoate, lead naphthanate, manganese naphthanate, zing naphthanate, calcium naphthanate, stannous octoate, zinc lactate and dibutyl tin dilaurate.

Since the catalyst activity will vary depending upon the exact catalyst selected, catalyst concentration can vary. However, since I generally desire a rapid initial cure of the fuel briquette, typically within a few seconds, I prefer to use relatively high proportions of catalyst, for example, in one current mode of practicing the invention I use one part of 4-alkyl pyridine to 3 parts of liquid polyisocyanate solution and 3 parts of phenolic resin solution.

While the above discussion deals with phenolic resin system catalysts, the following discussion deals with polyester resin system catalysts.

Catalysts are optionally but ordinarily used in conjunction with binder compositions containing both an isocyanate and a polyester resin, most especially a hydroxylterminated polyester resin. The catalysts which are usually employed are those which accelerate the air oxidation of the polyester resin, those which accelerate the reaction between the polyisocyanate and the polyester resin and those which do both. The amount of catalyst employed will be a catalytic amount, with the total amount of catalyst(s) usually ranging from 0.01–20% based on the combined weight of the polyisocyanate and hydroxyl-containing material. More frequently, from 0.1–15%, e.g. 0.25–10% catalyst will be used, on the same basis. The choice of catalyst and the amount thereof will affect the curing rate of the system. Metal naphthenates (e.g. cobalt naphthenate) are effective catalysts for both the isocyanate/hydroxyl reaction and the air oxidation of the polyester, the latter being their primary function. Metal ion catalysts such as tetra(hydrocarbyl) tin catalysts are also useful, as are dibutyl tin di-(hydrocarbyl) catalysts and dibutyl tin dilaurate and tin (II) octoate, tin oleate, tin hexoate, etc., though these last three catalysts are somewhat slower.

While I personally have not used the organic peroxide systems, based upon literature available, e.g., Modern Plastics Encyclopedia, I believe organic peroxides such as MEK peroxide and benzoyl peroxide should also be useful catalysts in combination with such materials as cobalt octoate, cobalt naphthenate, magnesium octoate, and dimethyl or diethyl aniline.

The exact amount of catalyst for any particular application is determined empirically, i.e., at present I add sufficient catalyst to ensure that the system can be mixed in less than about one minute and will set in the next succeeding minute.

Thus, it is impossible to unequivocally define the amount of catalyst used. However, based on my experience, good results appear to be obtained using more than about 10% of the bases described in the Robbins Patent and, while my experience is limited, I would expect a similar range to apply to the metal ion catalysts described in U.S. Pat. No. 3,432,457 Robbins for phenolic resin systems.

I would expect catalyst proportions of 0.01–20% to be useful with most hydroxyl containing material/-polyisocyanate reaction systems, and I currently believe this to a general preferred range of general application in the present invention.

Further, as will be apparent to one skilled in the art, the optimum catalyst for any particular system will vary. However, a few trial runs will permit an acceptable catalyst to be selected from the above enumerated catalysts.

Greater amounts of catalyst than necessary do not seem to overly affect the time of mixing or curing though curing time is somewhat inversely proportional to catalyst concentration; thus, while I may use amounts of catalyst much greater than about 10%, and often do, for phenolic resin systems, I do this to insure that if mixing is imperfect there is a certainty catalyst will be introduced throughout the system. For example, in Example 1, I calculate the catalyst roughly on the order of 50–65% of the phenolic resin, though this figure may be high since I purchase the catalyst commercially and my information comes from the suppliers.

However, if processing efficiency is not an overly important consideration and long curing times can be used, it is possible to use very low amounts of catalyst. For example, if it is acceptable to use a curing time of from 2 to 24 hours, it appears that the concentration of a metal salt catalyst can be on the order of 0.0001 to 10% of the phenolic or polyester resin and the bases of the Robbins Patent can be used in an amount on the order of 0.01 to 10% of the phenolic resin. Faster curing rates can be achieved by increasing the concentration of the catalyst above these rather low ranges, as I earlier indicated.

I typically use the binder system of the present invention in a 2-package or a 3-package form. In a 3-package form, the liquid polyisocyanate, phenolic or polyester resin and catalyst are each separate. In a 2-package form, the first package comprises an organic solvent solution of the phenolic or polyester resin and the catalyst and the second package comprises the liquid polyisocyanate, which is the hardener component.

At the time of use, all packages are combined with the metal waste material(s) and/or coke and/or coal.

In a currently non-preferred embodiment of the present invention I can use a tertiary amine as the catalyst for a phenolic resin system. While currently non-preferred, it is my expectation that this may prove to be a valuable commercial form of the invention since curing is substantially instantaneous. In this instance, the actual curing is accomplished in a manner similar to that described in U.S. Pat. No. 3,429,849 Robbins at Column 8. Specifically, once I mix the phenolic resin solution, the liquid polyisocyanate and the metal waste materials and/or coke and/or coal, I introduce the same into a mold and then pass an inert gas stream containing a tertiary amine through the mixture in the mold. The stream is passed through the mixture in the mold under sufficient pressure to penetrate the molded shape until the resin is cured. Usually a very dilute stream of the tertiary amine is sufficient to accomplish the curing, though concentrations of tertiary amine beyond that necessary to cause curing are not harmful. Air is typically used as the inert gas, though other gases such as nitrogen can be used, and concentrations of tertiary amine on the order of about 0.1 to 5% by volume in the inert gas stream are often used. While gaseous tertiary amines such as triethyl amine are preferred, I can also use liquid amines if suspended in a gaseous medium and then passed through the mold.

The expensive recovery and protective equipment involved with the use of gaseous or liquid amines makes them more expensive to use.

In a similar fashion, while a combination of a base, a metal ion and a gaseous or liquid amine can be used, this is also currently not preferred because of the recovery and protective equipment required.

Metal-containing Waste Material(s)/Coke and/or Coal

These components comprise the balance of the briquette.

I contemplate three basic embodiments:

1. Metal waste material(s) alone.
2. Coke and/or coal alone.
3. Metal waste material(s) and coke and/or coal.

Embodiment 1 provides a source of metal for use in processes as earlier described.

Embodiment 2 provides a fuel briquette which provides a source of fixed carbon for use in processes as earlier described.

Embodiment 3 provides both a source of metal and a source of fixed carbon for use in processes as earlier described.

While not limitative in any fashion, for Embodiment 1 I prefer to use up to about 92% wt%, more preferably up to about 90 wt%, based on briquette weight, of coke and/or coal. The general rule is, of course, that the more coke and/or coal present while retaining briquette strength, etc., the better.

Similar factors apply for Embodiment 2, i.e., I generally prefer to use maximum amounts of waste metal material(s), usually up to about 92 wt%, more preferably about 90 wt%, based on briquette weight.

For Embodiment 3, the total amount of metal waste material(s) and coke and/or coal is usually in the order of up to about 92 wt%, more preferably about 90 wt%, based on briquette weight, and the rate can be freely varied depending on the end use, e.g., where the briquette is to serve primarily as a fuel—source of fixed carbon—the coke and/or coal will predominate while when the briquette is to serve primarily as a source of metal, the metal waste material(s) will predominate. One skilled in the art can freely vary this ratio as needed.

There is no minimum limit on the metal waste and/or coke and/or coal, but obviously the lower the amounts thereof the less valuable the briquette of the present invention since binder system and magnesia costs will be higher. I would not foresee amounts thereof less than about 70% of the briquette weight being commercially attractive, however.

Additives

The present invention does not exclude the use of additives. These are optional in this invention and are conventional, i.e., you can use conventional metallurgical coke or coal additives as desired, e.g., to increase the carbon content or ease briquette processing as desired. This emphasizes the essential nature of the briquette of this invention. Unless the additive adds to the essential nature of the steel-making process, I prefer to use low amounts thereof, e.g., less than about 10%. The fixed carbon content can be brought to a higher specified carbon level with a carbon increaser such as a high carbon ground, such as sea coal or petroleum coke. However, it should be understood that such additives are optional herein. Further, of course, limestone can be present in the briquette of the present invention in amounts as desired since limestone serves as an excellent flux material in steel-making and related processes. It is to be specifically noted that in one highly preferred embodiment per the present invention limestone is used in proportions to provide a fluxing amount in steel making. Such limestone can serve not only as a source of CaO, a necessary flux in many steel making and like processes, but also as a source of MgO (magnesia).

Thus, in this preferred embodiment the briquette comprises a metal waste material(s)—a source of metal for the steel making, etc., process, coke and/or coal—source of fixed carbon, lime—a flux which also can provide magnesia if such is present, magnesia—if not present in the lime, and the binder system.

Processing Conditions

The process of the present invention in its basic form is simple. The metal waste material(s) and/or coke and/or coal, and a binder system comprising, e.g., one or more polyisocyanates, one or more hydroxy phenolic resins and preferably a catalyst and the magnesia source are mixed in the proportions earlier recited, substantially immediately placed into a mold, compressed and then permitted to set therein for a few seconds under compressive force, typically for a maximum of about 1 minute. If a tertiary amine is used, the catalyst is introduced once the mixture is in the mold, of course, due to the instantaneous set. Since processing is the same for the metal waste material(s) and/or coke and/or coal, in this section I merely refer to these generically as "particles".

The conditions selected for mixing are not overly important so long as the particles, magnesia source and binder system are well mixed, most desirably uniformly dispersed throughout the composition. It is important, however, that the mixture not be permitted to excessively set during mixing, i.e., prior to molding, since this could result in undesired product breakage. As will be appreciated by one skilled in the art, if the mixture does begin to set to any substantial degree during mixing, breakage could easily occur due to the mixing apparatus and it would be difficult, it not impossible, to easily introduce the mixture into the mold. One benefit of using a tertiary amine catalyst is that setting during mixing is no longer a problem.

Mixing can take only a few seconds and is conducted in a conventional manner. Usually, I mix for at most about 1 minute or less at ambient to ensure good dispersion. Heating during mixing does not appear to be desirable since this could result in an excessively rapid setting prior to molding when a catalyst is present, which for the reasons explained above, would be harmful. In certain instances, however, heating does appear to promote the setting of a binder system involving a rather slow setting system, and thus in certain instances heating may be desirable during setting and, of course, when curing is by baking, elevated temperatures will be used during curing.

The time after the completion of mixing to introduction into the mold is not critical in the sense that it must be done within seconds, but since the composition begins to set once the catalyst is contacted with the other components of the binder system, one should not delay in introducing the composition into the desired mold after setting has begun to any substantial degree since, in this case, molding cannot be conducted. The time involved is a matter of common sense, and, typically, upon the completion of mixing, but prior to setting, I thereafter substantially immediately introduce the composition into the desired mold except when using a tertiary amine catalyst when I can delay this step, if I desire.

One substantial benefit of the present invention is that setting can be conducted at ambient conditions. Thus, after I introduce the mixture into the mold, setting occurs in several seconds. Thus, as I have indicated above, it is important that the mixing time and the setting time be correlated.

In this regard, the bases of the Robbins patent are beneficial since work-time (mixing) can reasonably be predicted to be about 75% of the total time to set.

After setting in the mold for several seconds, seldom longer than 1 minute, the fuel briquette of the present invention can be removed from the mold and handled with safety.

After the briquette of the present invention is removed from the mold, I generally have found, with the binder systems used to date, that there is a slight increase in product durability in the few minutes following molding.

However, after the briquette is removed from the mold if the binder system is found to have an objectionable odor, I can then heat the briquette to assist in removing any slight amount of volatile components.

Prior to substantial setting of the briquette of the present invention in the mold, a compressive force is applied thereto. Since the setting composition is plastic during the initial period of setting (curing), compression increases the density of the fuel briquette and makes the same easier to handle and use. Where a tertiary amine is used, compression should first be applied due to the rapid set. In theory, I can compress during the initial stage when setting is beginning. However, care must be taken to insure that excessive pressure is not applied to a set briquette. Thus, for practical reasons I merely momentarily apply pressure to the mixture in the mold prior to the initiation of any substantial degree of setting, which achieves the results I desire, and thereafter remove the pressure. By proceeding in this fashion I do not have to be overly concerned with compressive rupture of a rapidly setting (or set) system, rather, I merely compact a plastic system which in a short period of time will be set.

Compression can be by any conventional means, and for certain uses compression by an amount equivalent to hand tamping is sufficient. However, I have found that for certain uses it is most preferred to compress the setting mixture under pressures beyond those achievable by handtamping, i.e., to use mechanical compression. In fact, I find that if the briquettes of the present invention are to withstand the rough material handling procedures commonly encountered in the industry, such must be compression molded.

What I desire to achieve by using compression of any type during setting is basically to increase the density of the final briquette as compared to an uncompressed briquette. It appears, based on results to date, that compression brings all components of the setting mixture into closer, more intimate contact and increases the final strength of the briquette, not only for purposes of handling but in addition increases the ability of the briquette to better withstand conditions of use in the manufacture of steel or iron, e.g., in blast furnace or cupola use, since I encounter lesser breakage of particles from the briquette during combustion thereof in a blast furnace or cupola.

Generally, any compressive forces tend to increase the durability of the briquette in blast furnace or cupola processing due to reduced breakage, but the effect of compression during setting for this purpose is especially pronounced at high pressures on the order of about 1000 lb/in$^2$ or more at present I prefer to use pressures of at least about 1300 lb/in$^2$ during setting, though I have noted a lesser effect of increased durability at lower pressures. For example, I currently apply a pressure of 1280 lb/in$^2$ on my current preferred composition and apparatus for a coke and/or coal containing briquette (whether or not a metal waste material is present) and a pressure of 1,600 lb/in$^2$ if no coke and/or coal is present.

Compression also provides a superior coke and/or coal based product, especially where the same is to be ground to a fine size as often burned by utility companies or ground to stoker size.

At present, after mixing the binder system magnesia and the particles, I introduce the composition, prior to setting, into a closed mold and apply a pressure as indicated above to the top of the setting mixture using a rectangular plate and a hydraulically activated piston.

While in theory it might be possible to achieve the above pressures using extrusion apparatus, I have found that coke or coal, most especially coke breeze, is such a hard material that the life of extrusion apparatus is limited. Thus, at present, I prefer to apply compressive force in a mold rather than in extrusion apparatus.

The exact minimum and maximum compressive force applied during setting will depend on a number of factors which can be balanced by one skilled in the art, as I now explain.

First, the compression should be sufficient to bring the particles into close, intimate contact. Since I often find a small amount of the binder to ooze to the surface of the mixture during compression setting, I believe I am compacting to an extent to increase the number of surface to surface contacts between the particles, whereby I achieve better binding.

Secondly, the compressive force should be sufficient to avoid any substantial proportion of what I call "super voids" in the briquette, i.e., voids larger than the particles. If these voids fill with binder, I do not achieve maximum binder utilization, which is disadvantageous. In many circumstances I compress to obtain a final briquette porosity and density similar to that of metallurgical coke. While I do not have the analytical equipment to exactly determine porosity, I estimate a good compacted briquette comprises on the order of 25% air space. This appears, at present, to provide an excellent product which combusts in a manner similar to metallurgical coke without excess breakage of small particles. In most cases, based on my experience to date, I find that application of a compressive force to reduce final briquette density to a value on the order of about 60% to about 85% of the density of an uncompacted briquette provides very good results.

Thirdly, it is my current view that one should not apply a compressive force in excess of the compressive strength of the particles, especially coal or coke. This could lead to shattering or crushing of the particles which would require, due to the increased surface area of the smaller particles, excessive amounts of the binder system. This increases cost and potentially the amount of binder components which might be introduced into, e.g., steel or iron upon use of the briquette.

In summary, if I apply compressive force to the setting mixture to get good contact between the particles and binder and get a porosity and density similar to metallurgical coke, I find I obtain reduced small particle break-off during briquette use.

Typically, compression is applied substantially simultaneously with introduction, i.e., just after introduction.

Conveniently, considering the apparatus I now use for compressive molding, the mixture is introduced into the mold and, immediately or after a second or two, pressure is applied to the setting mixture. Compression should, of course, be applied before the mixture has had an opportunity to substantially cure or set, since once the binder system hardens compressive force may shatter or crush the same. This is generally no problem if compression is applied shortly after introduction into a mold.

The total time of compression is not overly important, i.e., once the desired pressure is applied for a time sufficient to achieve the desired degree of compaction the pressure can be removed. Alternatively, the pressure can be maintained until setting is substantially completed or beyond the time setting is completed, but I currently see no benefits to be achieved by extended compression beyond the time required for setting, and unless critical attention is paid to the pressure applied, I could crumble or shatter the briquette. With a polyester based system, I currently compress for about three seconds.

While the term "mold" has been used herein, this term is not limited to a classical mold per se but includes other apparatus capable of performing a molding or forming function, which may also be used for the application of compressive force. For example, a closed mold can be used with a hydraulic ram disposed thereover to apply force to the setting mixture or any equivalent apparatus can be used. For example, to mold a fuel briquette of a 5"×5" cross-sectional area (25 in. sq$^2$), an applied ram pressure of 32,000 lbs provides an excellent product.

While the above operation is a batch operation, and my experience is limited to such, continuous molding should be possible with appropriate conventional mixing and feed apparatus.

The size of the briquette is not especially limited except that the briquette should be at least the size of commercially used coke or coal and should not be so large that it is not easily handled. Briquettes about the size of a small loaf of bread, a cement block, etc., are easily fabricated and handled, however.

I have earlier used the terms "expand" or "expansion" to describe the interaction of magnesia with the binder system of the present invention. More correctly, the briquettes of the present invention have a foam or cellular structure when allowed to set or cure without pressure application. With the application of pressure the briquettes do not present any substantial visible foam or cellular structure. However, without pressure the setting system quickly expands in volume once the magnesia source is added and at least the upper portion has a bubbly, cellular appearance, confirming the magnesia somehow reacts with the binder system.

When under a compressive force, obviously the magnesia cannot cause the molded briquette to expand. However, the interaction of the magnesia with the binder system causes the same to permeate throughout the particles and intimately bond the same. Thus, I use the "expansion" effect of the magnesia, while under pressure, to enhance binder system/particle contact, an important aspect of the invention.

The present invention having been generally described, the following example of the currently preferred best mode of practicing the present invention is offered.

EXAMPLE 1

The coke breeze utilized was taken directly from waste at a large steel-making plant. It had a final screening size of ¾" minus x 0 inch. The moisture content was on the order of 3–6%, by weight. It had not been subjected to any special treatment and comprised a mixture of coke breeze particles from a fine powder size up to pass a ¾" mesh, randomly distributed.

The binder system was as follows:

The phenolic resin was a phenol-formaldehyde resin in a solvent. The solvent was a 60/40 volume percent mixture of Solvesso/butyl Cellosolve acetate. The proportion of the phenolic resin therein was about 50%.

The phenol resin was produced as described in U.S. Pat. No. 3,409,579 Robbins for Resin B at Col. 8, i.e., as follows:

This resin was obtained by charging to a reflux system 720 g. of paraformaldehyde, 1014 g. of phenol, 15 g. of lead naphthenate solution (24%), and 120 ml. of benzene. The system was heated to reflux (105° C. to 125° C.) for six hours, during which water and benzene were distilled off. To the resin was added 100 ml. of benzene during the reflux. and 575 ml. of isopropanol at the end of the reflux. After five hours, 600 ml. of tetrahydrofuran were added to dilute the resin system. A total of 298 g. of water was distilled over. The resin and the solvent weighed 2520 g., and the resin was found to be a benzylic ether type of phenolic resin. This phenolic resin is available from the Ashland Chemical Company under the tradename ASHLAND RESIN A-6100.

The liquid polyisocyanate was also used in a solvent. The solvent was Solvesso. The liquid diisocyanate/solvent ratio was 75/25 volume %.

The liquid diisocyanate was one of the polymeric MDI type and was a mixture of the di- and triphenylmethane, di- and tri isocyanurate commercially available as "Mondur" MR. The liquid polyisocyanate was obtained from the Ashland Chemical Company under the tradename ASHLAND RESIN B-6330.

The catalyst used in this particular instance was 4-alkyl pyridine ($C_1$ to $C_4$ alkyl group) as disclosed in U.S. Pat. No. 3,702,316 Robbins. It was obtained from Ashland Chemical Company under the tradename ASHLAND CATALYST 6600.

The components used had the following physical properties:

| | Phenolic Resin | Polyisocyanate | Catalyst |
|---|---|---|---|
| Color | Amber | Dark Brown | Blue |
| Physical Form | Liquid | Liquid | Liquid |
| Specific Gravity | 1.086 | 1.134 | 0.910 |
| Weight/Gallon, lb | 9.03 | 9.34 | 7.49 |
| Flash Point, °F. (PM) | 120 | 130 | 125 |
| Viscosity (Stokes) | 1.00 | 0.22 | 0.22 |

The magnesia selected was dead-burned magnesite. It was a random particle size distribution such that 100% passed ⅜" minus, the particles ranging from just past ⅜" mesh to fine powder. Its chemical composition was as follows (all percentages are weight percentages):

| | |
|---|---|
| MgO | 87.3% |
| $SiO_2$ | 4.6% |
| CaO | 4.2% |

-continued

| | |
|---|---|
| $Fe_2O_3$ | 2.7% |
| $Al_2O_3$ | 1.2% |

It was a commercially available product from Basic Refractories under the name BRI Magnesite DB-87.

Using the above components, I mixed four pounds of coke breeze as described with three ounces of the phenol resin solution, three ounces of the liquid polyisocyanate solution, one ounce of the catalyst solution and four ounces of the magnesia. Mixing took approximately one minute. All components were vigorously mixed until the mixture gained plasticity. Mixing was in a conventional mixing apparatus having a vertically oriented stirrer. The resins of the binder systems of the present invention have a sufficiently long shelf life, e.g., 4 hours, for practical use until the catalyst is introduced.

I then placed the resulting mixture immediately into a rectangular mold in a Columbia Model 10 2 block concrete block machine, and vertically vibrated the mixture for about 30 seconds to insure all particles were densified (settled) in the binder system. The mixture had not begun to expand to any substantial degree at the end of the vibration. I generally find that vibration to settle all particles as much as possible provides a much denser, stronger briquette and, of course, permits lesser amounts of binder to be used. Any conventional vibration means can be used and such is standard on the Columbia block machines. Then, by way of a rectangular plate, I applied a pressure of 16 tons to the exposed area of the mixture which had an area of 25 square inches.

After pressure application, which is only for a period of five seconds maximum, and prior to substantial setting, I then removed the compressive force from the mixture and removed the resulting set fuel briquette from the mold. The pressure was sufficient to prevent expansion of the binder system, and upon sawing the briquette, I found that the interior had a dense, solid structure which confirmed complete binder system permeation.

All of the above procedures were conducted at ambient conditions, i.e., at about 25° C.

The briquette had sufficient green strength to be easily handled without breakage upon removal from the mold and in the next few minutes, e.g., within ten minutes, achieved good product stability for use. The briquette had dimensions of approximately 5"×5"×7".

EXAMPLE 2

The coke breeze used was the same as in Example 1, as were other processing conditions unless otherwise indicated.

The binder resin system was a hydroxyl-terminated polyester/liquid polyisocyanate system.

The hydroxyl-terminated polyester was the reaction product of pentaerythritol, di-ethylene and tri-ethylene glycol and a mixture of $C_6$–$C_9$ unsaturated dibasic acids. The hydroxyl value thereof was 212.

The liquid polyisocyanate had 2–5 aromatic isocyanate groups and is available under the name "Papi" from Upjohn Polymer Chemicals. The "Papi" materials I believe useful are dark-brown polymethylene polyphenylene isocyanates with an average "functionality" of 2.3~2.7, an isocyanate equivalent of 133~133.5 and an NCO content of 31.5~31.6.

The hydroxyl-terminated polyester was used as a 75% resin solution in a conventional Solvesso solvent. The polyisocyanate was used as a 90~95% resin solution in a xylene/xylenol solvent.

In this example a catalyst of the dibutyl tin dilaurate type was used, i.e., a metallic tin salt catalyst. It was mixed in with the polyester resin solution in an amount of less than 5% based on the polyester resin, this is a two-component system. It was purchased from United Erie, Inc., uner the name United Deep Set.

The mixing ratio was:

| | |
|---|---|
| polyisocyanate solution | 36 lbs. |
| polyester resin | 54 lbs. |
| coke breeze | 2,000 lbs. |
| magnesia as per Example 1 | about 26 lbs. |

In my work I have not encountered substantial product variations with polyester systems where the metal salt catalyst has varied.

Processing was otherwise as per Example 1 except compression time was about three second maximum, and results similar to those of Example 1 were obtained.

EXAMPLE 3

The materials used in this Example were essentially the same as in Example 2 except the polyester, polyisocyanate and catalyst were purchased from United Erie under the tradename "Deepset". The coke breeze, magnesia and processing conditions were as per Example 2 except the following proportions were used:

| | |
|---|---|
| polyisocyanate | 1.5 oz. |
| polyester (contains the catalyst) | 2 oz. |
| coke breeze | 4 lb. |
| magnesia | 5 oz. |

Results similar to those of Example 2 were obtained.

EXAMPLE 4

The process conditions were the same as for Example 2. However, the briquette was formed from the following composition.

| | |
|---|---|
| Mill scale (⅛" to 0) | 44 lb. |
| Cast iron engine borings (⅛" to 0) | 44 lb. |
| Lime* | 3 lb. |
| Coke breeze (as per Example 1) | 2 lb. |
| Binder System** | 7 lb. |

*Finely ground; as wt %, 56.58 CaO, 42.50 MgO, balance iron oxide, alumina and silicon dioxide.

Results similar to those of Example 2 were obtained.

Duplicating the above Example except for omitting the coke breeze and using 2 lb. of magnesia as per Example 1, equivalent results were obtained.

Steel-Making Aspects Of The Present Invention

As earlier indicated, the briquette of the present invention finds use in one embodiment as a partial replacement for metallurgical coke in conventional steel-making or gray iron-making processes, i.e., it is useful not only in steel-making step per se but in earlier pig iron formation steps and subsequent processing. The briquette of this invention can be used to totally replace coke, if desired, wherever it is used as a fuel reductant, in a blast furnace or other reduction processes or in melting processes such as in a foundry cupola, etc. Such processes are so well known that no further discussion is believed necessary. The present invention modifies such processes merely by replacing, in whole or in part, the coke conventionally used therein with the fuel briquette of the present invention; no other changes of substance are needed since the fuel briquette of the present invention essentially retains the product characteristics of the present coke from which it is formed. The minor amount of binder does not adversely affect these base characteristics and permits the fuel briquette of this invention to be used in layered form similar to metallurgical coke and not to break down to any harmful extent under the weight of the overlying limestone and steel scrap or iron ore, or under head, until the entire melt has finished processing.

For all steel- and iron-making processes which I have known about, it appears that at least from about 10 to about 20% of the coke can be replaced by the briquette without any problem, though these percentages are, I believe, conservative, and high percentages of briquette can probably be used in many industrial applications. One skilled in the art will easily be able to calculate the desired levels of briquette use.

In similar fashion, a briquette per the present invention which contains a metal-containing waste material(s) can be used to supplement or replace the metal charge in such processes, though generally it is used as a supplement.

While not limitative, illustrative of blast furnace operations wherein the briquette of the present invention finds use as a partial or complete replacement for coke (or a coke-type material used therein) are those described in U.S. Pat. Nos. 3,537,841, Wendel; 3,522,034, Bailey; 3,239,331, Menk et al.; etc.

While the invention has been described in detail and with reference to specific embodiments thereof, it will be apparent to one skilled in the art that various changes and modifications can be made therein without departing from the spirit and scope thereof.

What is claimed is:

1. A compressed briquette formed from a composition comprising a member selected from the group consisting of one or more metal-containing materials, coke, coal and a mixture thereof, magnesia and a cross-linked reaction product of a reactive isocyanate group-containing compound and a reactive hydroxyl group-containing resin, said reaction product being present in an amount effective to bind said briquette together.

2. The briquette of claim 1 wherein said reactive isocyanate group-containing compound is a polyisocyanate with from 2 to 5 isocyanate groups.

3. The briquette of claim 2 wherein said reactive hydroxyl group-containing resin is a phenolic resin.

4. The briquette of claim 3 wherein said phenolic resin is a phenol-aldehyde resin.

5. The briquette of claim 4 wherein said cross-linked reaction product is formed at room temperature using a catalyst.

6. The briquette of claim 5 wherein said catalyst is a metal ion.

7. The briquette of claim 5 wherein said catalyst is a base having a pKb of about 7 to about 11.

8. The briquette of claim 7 wherein said base is a 4-alkyl pyridine, where the alkyl group has 1 to 4 carbon atoms.

9. The briquette of claim 5 wherein said catalyst is a tertiary amine.

10. The briquette of claim 1 consisting essentially of the reacted components.

11. The briquette of claim 2, wherein said reactive hydroxyl group-containing resin is a polyester resin.

12. The briquette of claim 11, wherein said polyester resin is a hydroxyl-terminated polyester resin.

13. The briquette of claim 12, wherein said hydroxyl-terminated polyester resin is the reaction product of pentaerythritol, one or more polyethylene glycols and an unsaturated dibasic acid.

14. The briquette of claim 13, wherein said one or more polyethylene glycols are di- and triethylene glycol and said unsaturated dibasic acid comprises $C_6$–$C_9$ unsaturated dibasic acids.

15. The briquette of claim 11, wherein said cross-linked reaction product is formed at room temperature using a catalyst.

16. The briquette of claim 15, wherein said catalyst is a metallic salt.

17. A process for forming a briquette as claimed in claim 1 which comprises:

(1) mixing a member selected from the group consisting of one or more metal-containing materials, coke, coal and a mixture thereof, and magnesia with a reactive isocyanate group-containing compound and a reactive hydroxyl group-containing resin at ambient temperature and, before the resulting mixture can set to any substantial degree;

(2) introducing said mixture into a mold at ambient temperature and, before the mixture in the mold can set to any substantial degree, applying a compressive force to the mixture to compact the mixture;

(3) curing the reactive isocyanate group-containing compound and the reactive hydroxyl group-containing resin in the presence of a catalyst to form a cross-linked product while said mixture is in said mold; and (4) removing the resulting briquette from the mold.

18. The process of claim 17 wherein the mixture is vibrated to densify particles therein prior to applying the compressive force.

19. The briquette of claim 1 wherein at least coke is present and said coke is coke breeze.

20. The briquette of claim 1 wherein at least one or more metal containing materials are present.

21. The briquette of claim 20 wherein at least one or more metal containing materials and coke are present and the coke is coke breeze.

* * * * *

UNITED STATES PATENT AND TRADEMARK OFFICE

CERTIFICATE OF CORRECTION

PATENT NO. : 4,497,661

DATED : February 5, 1985

INVENTOR(S) : Nicholas Valenti

It is certified that error appears in the above-identified patent and that said Letters Patent is hereby corrected as shown below:

On the cover page of the issued patent, left column, kindly delete "[73] Assignee: Ohio & Pennsylvania Fuels Co, Ltd., Maryfield Heights, Ohio".

Signed and Sealed this

*Seventeenth* Day of *September 1985*

[SEAL]

*Attest:*

DONALD J. QUIGG

*Attesting Officer*

*Commissioner of Patents and Trademarks—Designate*